US006019560A

United States Patent [19]

Uchida et al.

[11] Patent Number: 6,019,560

[45] Date of Patent: Feb. 1, 2000

[54] APPARATUS FOR SUPPLYING PAPER TO BOOK PRODUCING MACHINE

[75] Inventors: Hitoshi Uchida, Kyoto; Yoshinari Kuwabara, Tokyo, both of Japan

[73] Assignee: Horizon International, Inc., Shiga, Japan

[21] Appl. No.: 08/763,473

[22] Filed: Dec. 11, 1996

[30] Foreign Application Priority Data

Feb. 17, 1996 [JP] Japan ..... 8-066993
Feb. 17, 1996 [JP] Japan ..... 8-066996

[51] Int. Cl.[7] ..... B42C 5/00

[52] U.S. Cl. ..... 412/25; 412/11

[58] Field of Search ..... 412/1, 9, 11, 14, 412/17, 18, 19, 21, 24, 25, 37, 901, 902

[56] References Cited

U.S. PATENT DOCUMENTS 2,640,207 6/1953 Florez et al. ..... 412/24
3,101,493 8/1963 Carstens ..... 412/19 X
3,179,967 4/1965 Yohn et al. ..... 412/37 X
5,318,398 6/1994 Kojima ..... 412/18
5,662,448 9/1997 Graushar et al. ..... 412/19

*Primary Examiner*—Willmon Fridie, Jr.
*Attorney, Agent, or Firm*—Majestic, Parsons, Siebert & Hsue, P.C.

[57] ABSTRACT

A paper supplying apparatus has a rotatable member around a horizontal axis, a pair of clamp plates supported by this rotatable member mutually parallel and in face-to-face relationship for clamping a book block in between, and guide plates each attached to an associated one of these clamp plates, extending downward from the clamp plates to a lower edge part of the book block when the book block is held vertically. Such a paper supplying apparatus can be removably connected to a book binding machine by attaching a guide rail to an outer wall of the book binding machine and a runner to the paper supplying apparatus. The runner is slidably engageable with the guide rail, allowing the paper supplying apparatus to move along the guide rail selectably towards or away from the book binding machine.

8 Claims, 10 Drawing Sheets

APPARATUS FOR SUPPLYING PAPER TO BOOK PRODUCING MACHINE

BACKGROUND OF THE INVENTION

This invention relates to an apparatus for supplying paper to a book producing (or binding) machine, as well as to a mechanism for connecting such an apparatus to the book binding machine.

A book binding machine of the kind to which this invention relates, as shown at 1 in FIGS. 13 and 14, comprises a clamping station 2, a milling station 3, a gluing station 4 and a nipping station, and a clamper 6 having a mobile clamp plate 7, and a stationary fixed clamp plate 8 is provided and adapted to visit these sections sequentially.

The clamping station 2 is where the page sheets 15 sent from a printer or a copier are piled up sequentially according to their page numbers. The pages for one book thus piled in the right order and ready to be clamped together will be hereinafter referred to as "the book block". Each book block 16 is inserted between the mobile clamp plate 7 and the fixed clamp plate 8 of the clamper 6 such that the back surface 18 of the book block 16 will be opposite a level plate 9, and the book block 16 thus inserted is moved to the side of the mobile clamp plate 7 facing the fixed clamp plate 8 so as to be clamped by the clamper 6. The milling station 3 is where the back surface 18 of the book block 16 clamped by the clamper 6 in the clamping station 2 is made uniform by means of a milling machine. The gluing station is where a glue is applied by a gluing machine 11 on the back surface 18 of the book block 16 made uniform at the milling station 3. The processes at the milling station 3 and the gluing station 4 are carried out while the book block 16 remains clamped by the damper 6 and moved thereby. At the nipping station 5, one of the cover sheets 17 on a stoker (or a cover sheet table) is already taken to nipping plates 12, 13 and set at a specified position. The book block 16 clamped by the damper 6 and having its back surface 18 preliminarily glued is positioned above and between the nipping plates 12, 13. Both the nipping plates 12, 13 and their bottom plate 14 are raised slightly such that the back surface 18 of the book block 16 is glued to the cover sheet 17 with the book block 16 sandwiched between the cover sheet 17 and contacted to the bottom plate 14 between the nipping plates 12, 13. At about the same time, the nipping plates 12, 13 are moved such that the cover sheet 17 is folded while edge parts of the back surface 18 of the book block 16 are tightened from both sides, thereby causing the cover sheet 17 to become attached to the book block 16.

With a book binding machine as described above, it is its operator that forms the book blocks and inserts them one by one between the mobile clamp plate 7 and the fixed clamp plate 8. There are situations, as shown in FIG. 15, however, where a paper supplying apparatus 20 may be set near the clamping station 2 of the book binding machine 1 and a printer or a copier 10 is set near the paper supplying apparatus 20 such that printed sheets 15 can be sequentially supplied from the printer or the copier 21 first to the paper supplying apparatus 20 where they are piled and made into a book block 16 and that the book block 16 thus formed is then clamped by a damper 31 attached to a rotary arm 30 as shown in FIG. 16 and inserted between the mobile clamp plate 7 and the fixed clamp plate 8 of the damper 6. In other words, there are situations where all the processes from printing or copying to binding books are carried out automatically in a continuous flow.

When the paper supplying apparatus 20 is thus used in combination with the book binding machine 1, the book block 16 is generally inserted from above into the damper 6 because the damper 6 for the book binding machine 1 is usually of a center impeller type for securing sufficient strength. If the book block 16 is inserted from above, however, it often happens that the bottom part of the book block 16 expands, as shown in FIG. 17, because some of the sheets 15 may be naturally warped, and the insertion of the book block 16 may not be effected easily or properly.

Another problem associated with using the paper supplying apparatus 20 in combination with the book binding machine 1 is a matter of space. When an operator has a work to do with the book binding machine 1, for example, there is not enough space for the operator, and the work of inserting the book block 16 at the clamping station becomes very difficult. In view of this difficulty, it has been known to provide the book binding machine 1 with an additional clamping station 2 for the paper supplying apparatus 20. This, however, has the unfavorable effect of making the book binding machine 1 larger in size and complicated in structure, requiring a large floor space for its installation.

SUMMARY OF THE INVENTION

It is therefore an object of this invention in view of the above to provide a paper supplying apparatus for a book binding machine capable of inserting a book block dependably into the damper even in the case of naturally warped pages without adversely affecting the strength of the damper of the book binding machine.

It is another object of this invention to provide a connecting mechanism between a paper supplying apparatus and a book binding machine which does not require any additional clamping station and is capable of connecting the paper supplying apparatus and the book binding machine while providing a sufficient space for an operator and the paper supplying apparatus such that maintenance work on the book binding machine can be carried out easily.

A paper supplying apparatus embodying this invention for supplying a book block from above to a damper for a book binding machine, with which the above object can be accomplished, may be characterized as comprising not only a rotatable member around a horizontal axis and a pair of clamp plates supported by this rotatable member mutually parallel and in face-to-face relationship for clamping the book block therebetween, but also guide plates each attached to an associated one of these clamp plates so as to extend downward from the clamp plates to a lower edge part of the book block when the book block is held vertically. Such downwardly protruding guide plates can limit the outward swelling of the bottom edge part of the book block and allows the book block to be reliably delivered vertically to the damper of the book binding machine.

A connecting mechanism embodying the invention may be characterized as comprising a guide rail attached to an outer wall of the book binding machine and a runner attached to the paper supplying apparatus. The runner is slidably engageable with the guide rail, allowing the paper supplying apparatus to move along the guide rail selectably towards or away from the book binding machine. With the paper supplying machine thus connected to the book binding machine removably, they can be easily separated, wherever necessary, to make a room for a worker near the book binding machine, say, for carrying out a maintenance work.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, components that are equivalent or substantially similar are indicated by the same numerals for convenience even if they belong to different apparatus.

DETAILED DESCRIPTION OF THE INVENTION

Figure 6:
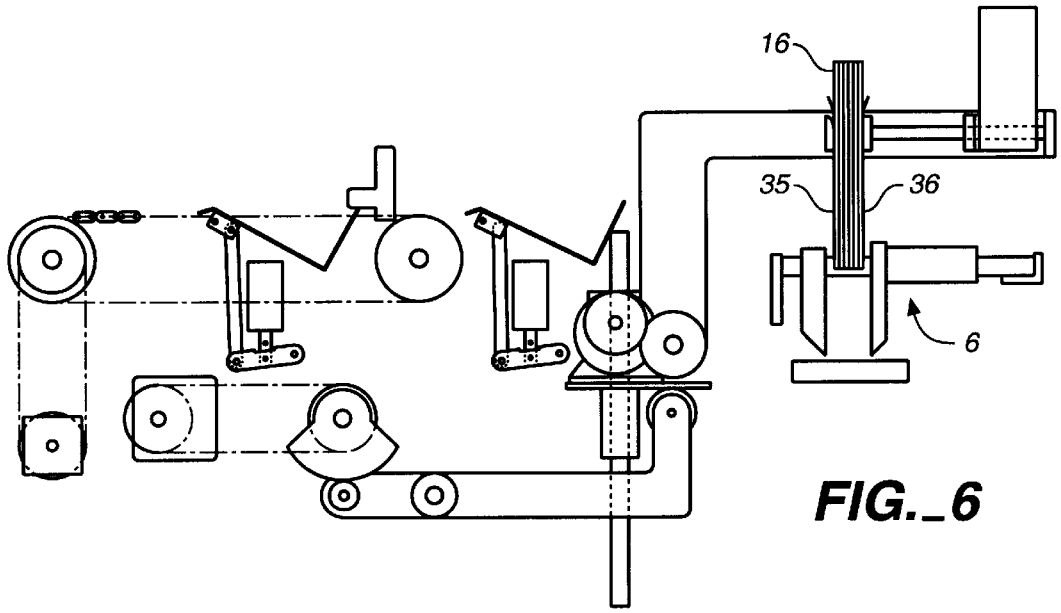
Figure 7:
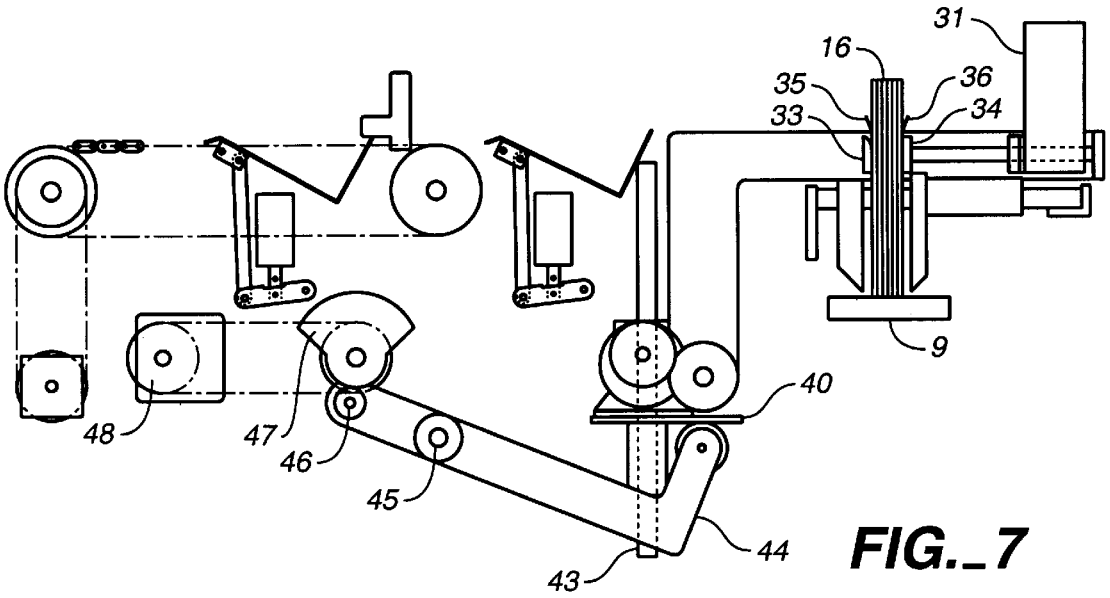
Figure 8:
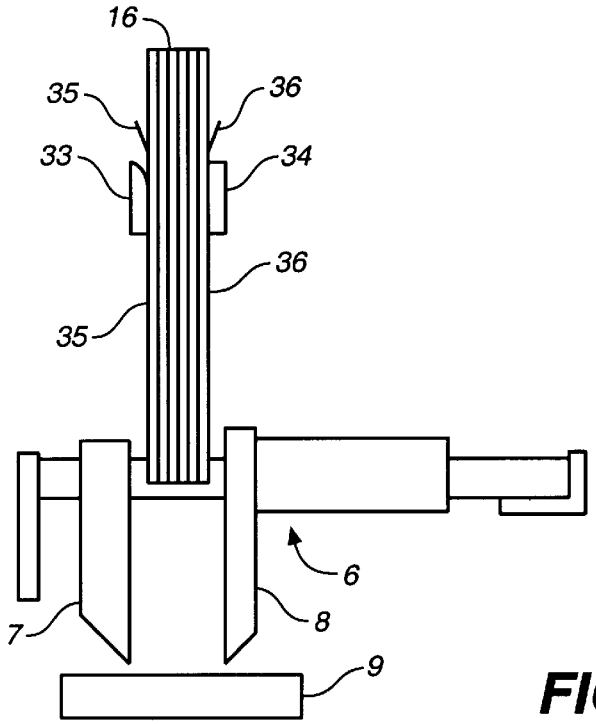
FIG. 8 is an enlarged side view of a portion of the paper supplying apparatus of FIGS. 1 and 2.

FIGS. 1–8 are referenced to describe a paper supplying apparatus 20 embodying this invention. The apparatus 20 has a clamper comprised of an L-shaped member (the arm) 30, a clamping motor 31 affixed to one end of the arm 30 and a rack gear 32 connected to the drive shaft of this motor 31 such that the rack gear 32 can undergo a reciprocating linear motion as the motor 31 is rotated in the positive and negative directions. A mobile clamp plate 33 is attached to one end of the rack gear 32, and a fixed clamp plate 34 is affixed to the arm 30 opposite to and in a face-to-face relationship with the mobile clamp plate 33. A book block (or a piled assembly of page sheets ready to be bound into a book) 16 is adapted to be inserted between the mobile clamp plate 33 and the fixed clamp plate 34 with guide plates 35 and 36 inserted respectively between the book block 16 and the mobile clamp plate 33 and between the book block 16 and the fixed clamp plate 34, as shown more clearly in FIG. 8. These guide plates 35 and 36 are relatively thin plates which extend downward approximately to the bottom edge of the book block 16 when it is clamped between the mobile and fixed clamp plates 33 and 34 in a vertical orientation as shown in FIG. 8, and are affixed respectively to the mobile and fixed clamp plates 33 and 34, depending on the size of the book block 16. A gear 37 is affixed to the other end part of the arm 30 where the arm 30 is rotatably attached to a table 40 which supports an arm-driving motor 41. A gear 42 is affixed to the drive shaft of this motor 41 and engages with the gear 37 on the arm 30 such that the arm 30 can rotate around a horizontal axis in the clockwise or counter-clockwise direction as the motor 41 is rotated in the positive or negative direction. A vertically extending guide shaft 43, which is appropriately affixed to the main body of the apparatus, penetrates the table 40 slidably such that its position can be adjustably set through a link 44 adapted to rotate around an axis of rotation 45. A cam follower 46 is affixed at one end part of the link 44 in contact with a cam 47. The cam 47 is connected to the drive shaft of a cam-rotating motor 48 through a chain 49 or the like such that the rotation of this motor 48 will cause the link 44 to rotate around the axis of rotation 45 as the contact point of the cam follower 46 changes between the hill portion and the valley portion of the cam 47, causing the table 40 to move vertically upward or downward along the guide shaft 43. A conveyer chain 50, having a pusher 51 attached thereto, is provided for transporting the book block 16 into the space between the mobile and fixed clamp plates 33 and 34 when the arm 30 is in its standing-up position shown in FIG. 3. The conveyer chain 50 is stretched between a first chain wheel 52 near the arm 30 when it is in the standing-up position and a second chain wheel 53 located farther away therefrom and is adapted to move over around or reciprocatingly between the two chain wheels 52 and 53 by the rotation of a chain-driving motor 54. A first stopper 55 is disposed between the two chain wheels 52 and 53, serving to stop the page sheets which are sent from a printer or the like (not shown) to form the book block 16 for one book. A solenoid 56 is provided for retracting the first stopper 55 from the trajectory of the book block 16 on the conveyer chain 50 after the book block 16 has been formed. A second stopper 60 is provided on the downstream side of the conveyer chain 50 for receiving and stopping the book block 16 pushed by the pusher 51 on the conveyer chain 50. It is also adapted to be retracted by means of another solenoid 61 such that the arm 30 or the book block 16 will not be damaged as the arm 30 is swung around after the book block 16 has been inserted between the mobile and fixed clamp plates 33 and 34.

Figure 1:
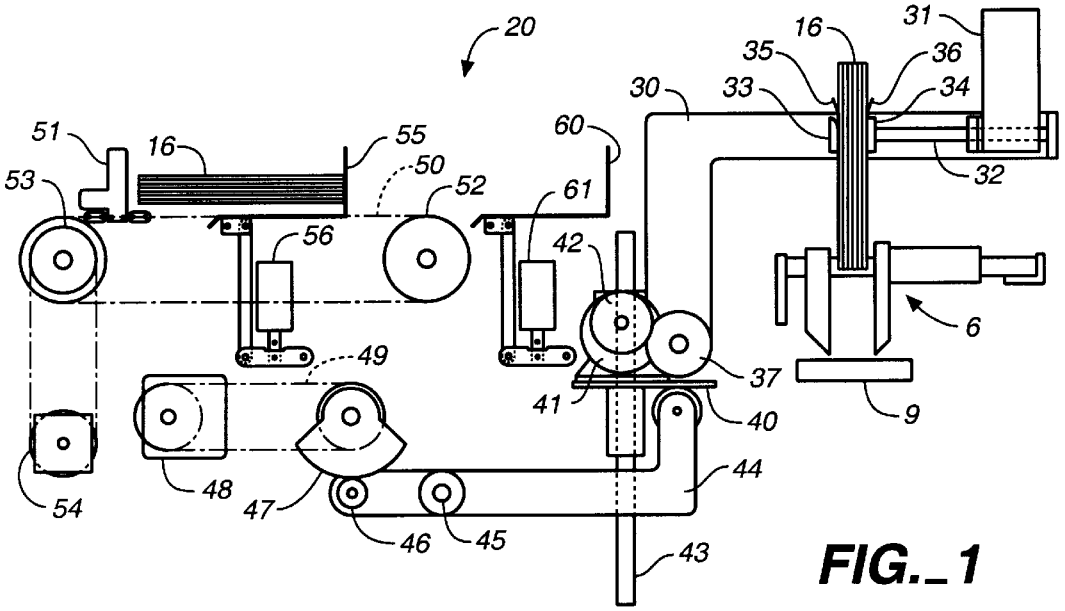
FIG. 1 is a schematic side view of a paper supplying apparatus embodying this invention for a book binding machine.
Figure 2:
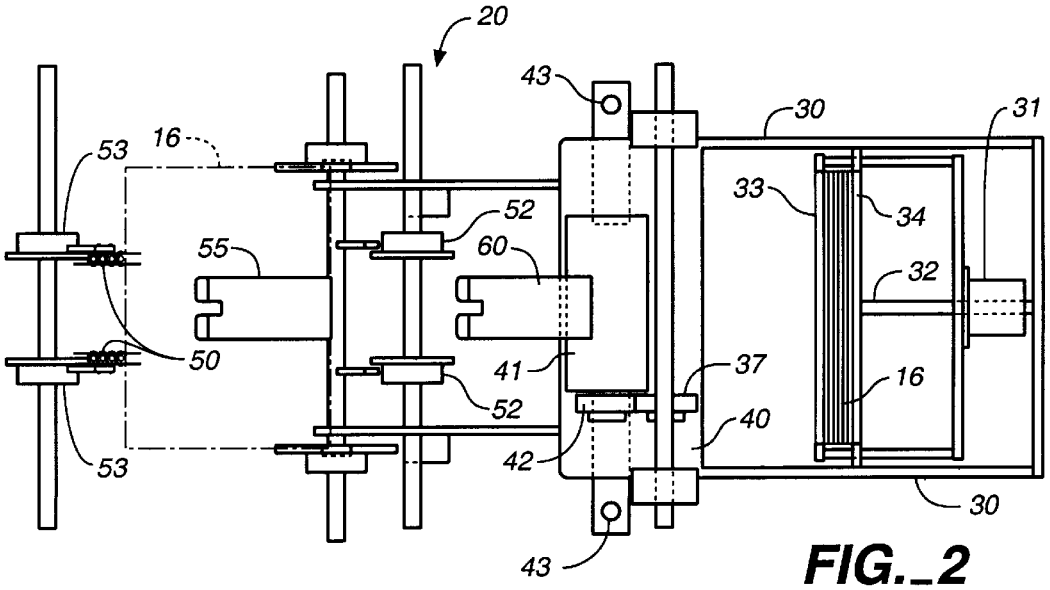
FIG. 2 is a plan view of the paper supplying apparatus of FIG. 1.
Figure 3:
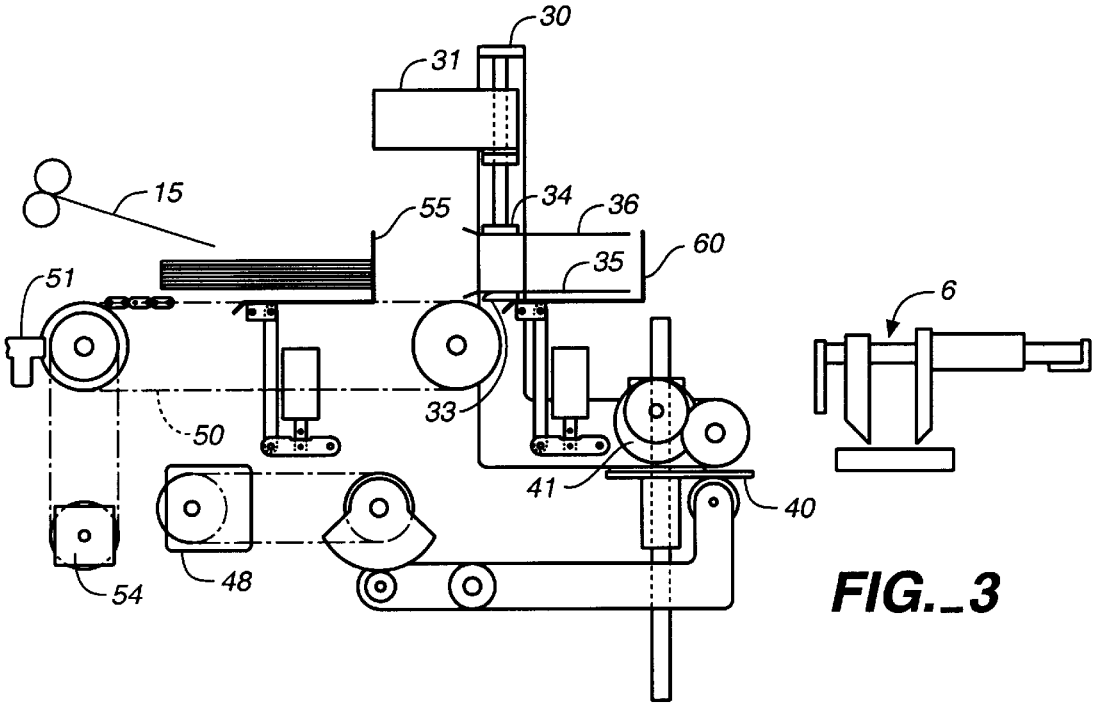
FIGS. 3–7 are side views of portions of the paper supplying apparatus of FIGS. 1 and 2 at various points in time of its operation.
Figure 4:
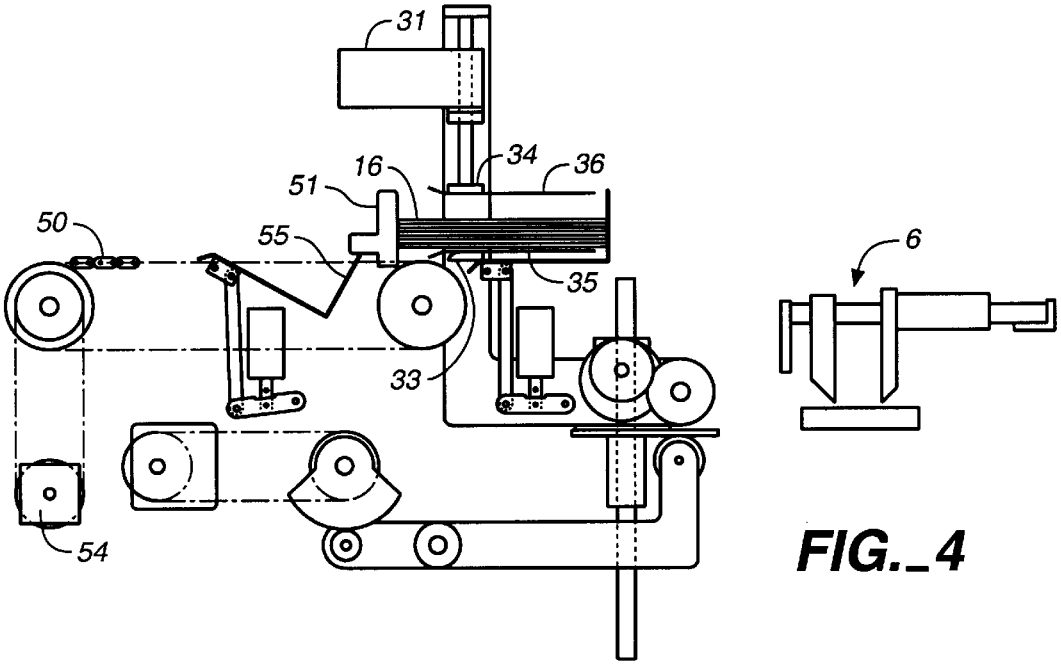
Figure 5:
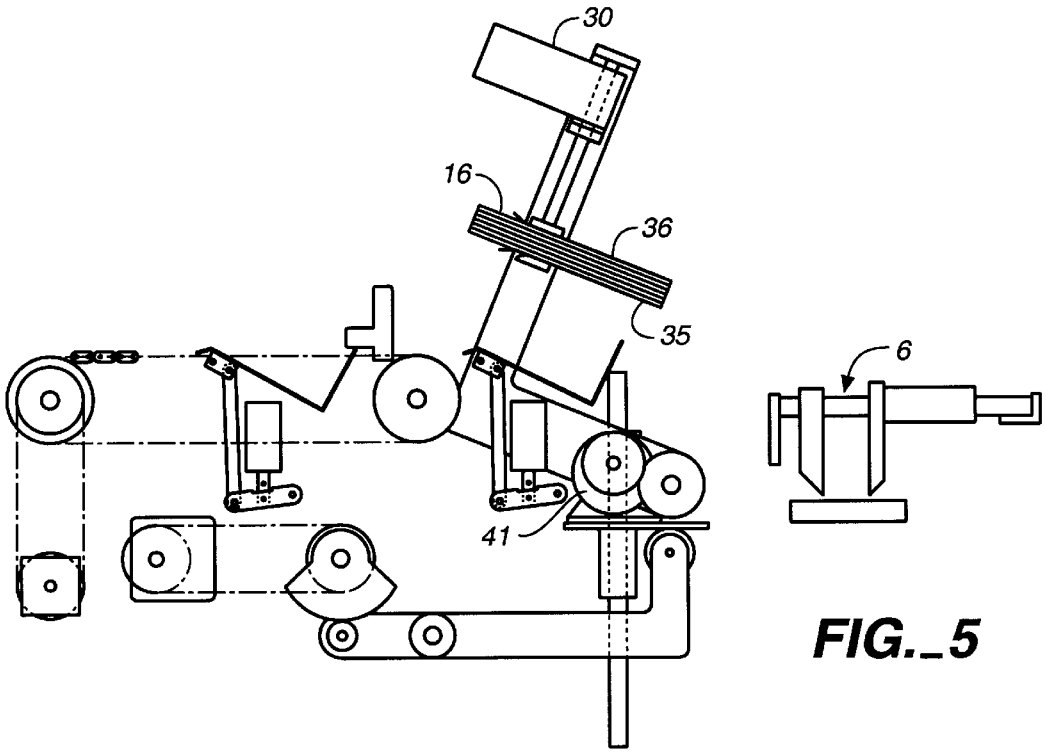

Next, the operation of the paper supplying apparatus thus structured will be explained in detail with reference to FIGS. 3–7. When printed page sheets 15 are sequentially received from a printer or the like (not shown), as shown in FIG. 3, the motors 31, 41, 48 and 54 are not activated yet, the arm 30 is in the standing-up position with the mobile and fixed clamp plates 33 and 34 in the open condition, and the table 40 is in the raised position. FIG. 3 also shows the guide plates 35 and 36 attached respectively to the mobile and fixed clamp plates 33 and 34. After a book block 16 (corresponding to one book) is formed, the chain-driving motor 54 is activated, the chain 50 begins to move and the pusher 51 comes into contact with the book block 16. The first stopper 55 is then retracted, and as the chain 50 continues to move, the book block 16 moves towards the arm 30, pushed by the pusher 51, and is inserted between the guide plates 35 and 36 fastened respectively to the mobile clamp plate 33 and to the fixed clamp plate 34, as shown in FIG. 4. The clamping motor 31 is activated thereafter to cause the mobile clamp plate 33 to move towards the fixed clamp plate 34 such that the book block 16 is clamped between the two guide plates 35 and 36. Next, the arm-driving motor 41 is activated for rotating the arm 30 in the clockwise direction, as shown in FIG. 5, until the book block 16 becomes substantially vertical and its lower edge comes to a position above the damper 6 of the book binding machine, as shown in FIG. 6, when the arm-driving motor 41 is deactivated and the rotation of the arm 30 is stopped. FIG. 8 shows more clearly the condition of the damper 6 at this moment. Since the guide plates 35 and 36 extend downward almost to the bottom edge of the book block 16, the bottom edge part of the book block 16 is prevented from expanding sideways or becoming non-uniform.

Next, the cam-rotating motor 48 is activated to rotate the cam 47, and the cam follower 46 comes to contact the valley part of the cam 47. This causes the link 44 to rotate in the clockwise direction around the axis of rotation 45, and the table 40 supported by the link 44 moves down to its downward position. As the table 40 thus moves downward, the book block 16 and the guide plates 33 and 34 supported by the arm 30 are inserted into the damper 6 of the book binding machine. When the lower edge of the book block 16 nearly contacts the level plate 9, as shown in FIG. 7, the downward motion of the table 40 is stopped.

Next, the clamping motor 31 is activated again to move the mobile clamp plate 33 away from the fixed clamp plate 34, thereby releasing the book block 16, and as the cam 47 continues to rotate, the cam follower 46 comes to contact the hill part of the cam 47, thereby causing the table 40 to move upward along the guide shaft 43. As the table 40 thus moves upward, the guide plates 35 and 36 move away from the damper 6, and as the arm 30 stops rotating and returns to its original position, the cam-rotating motor 48 is stopped and the table 40 stops at its original position (that is, the position as shown in FIG. 6 except the book block 16 is not present). The damper 6 is then activated at about the same time so as to clamp the book block 16 which has been received.

Figure 9:
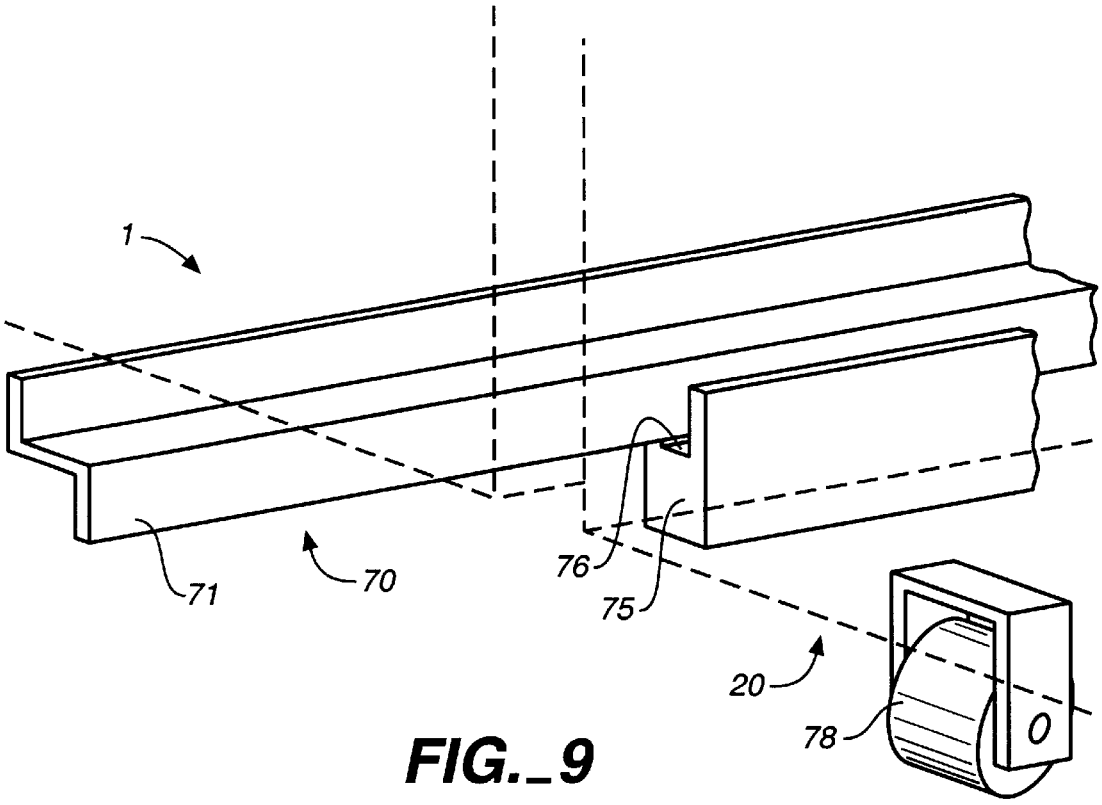
FIG. 9 is a diagonal view of a portion of a mechanism embodying this invention for connecting a paper supplying apparatus with a book binding machine.
Figure 10:
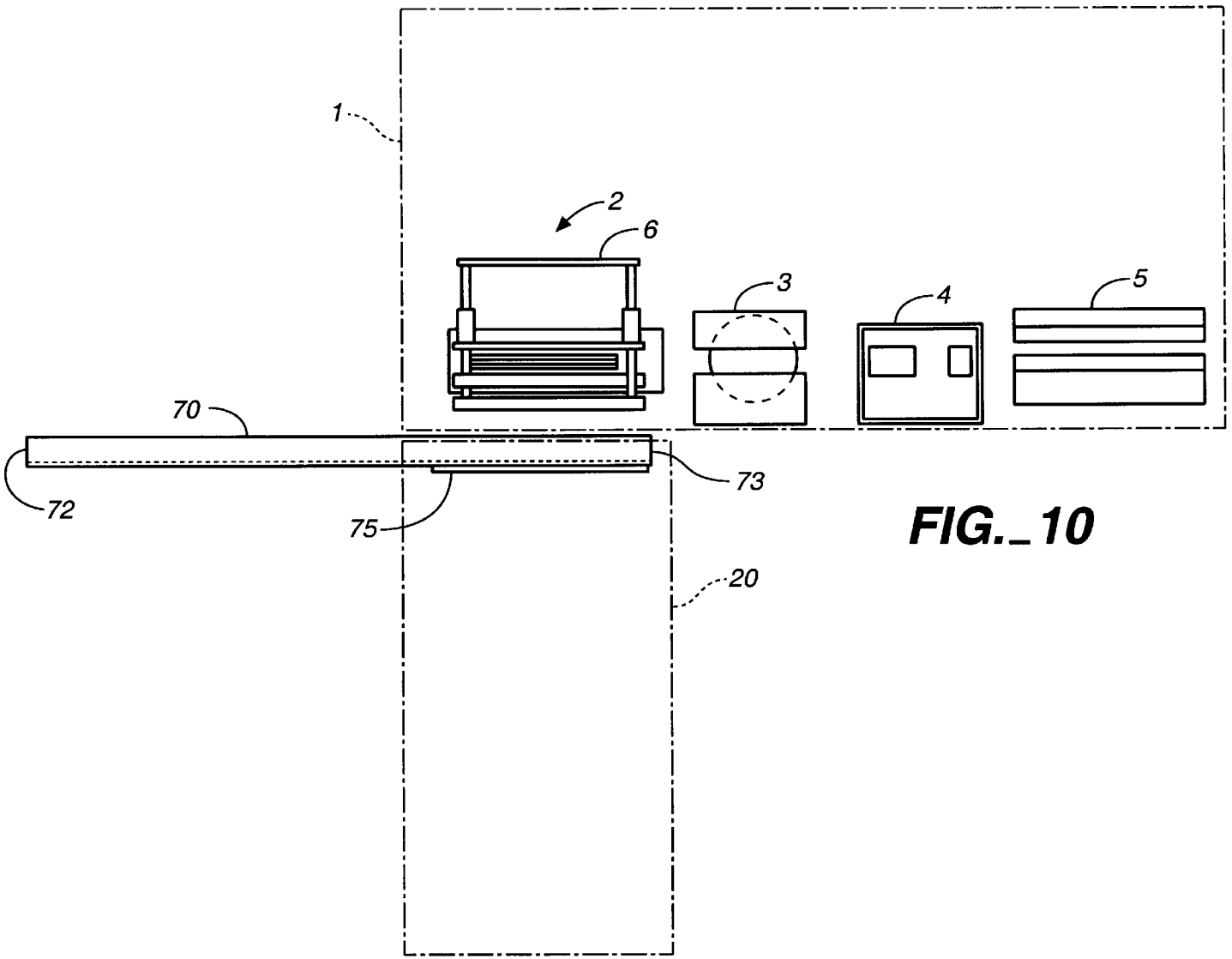
FIG. 10 is a schematic plan view of a paper supplying apparatus and a book binding machine connected by a mechanism embodying this invention.

According to a preferred embodiment of this invention, the book binding machine 1 is provided with a horizontally oriented guide rail 70 attached to a lower part on the outside of one of its outer walls with one end thereof extending outward therefrom and the end at a position corresponding to the side of the clamping station 2 proximal to the milling station 3, as shown in FIGS. 9 and 10. The guide rail 70, according to the embodiment shown in FIG. 9, has an cross-sectional shape of an L with the horizontal part bent downward at the edge (as indicated by numeral 71), and stoppers 72 and 73 are provided at both ends thereof. These stoppers 72 and 73 are not essential, but the one (indicated by 73) opposite the end of the clamping station 2 facing the milling station 3 is desirable because it serves to properly position the paper supplying apparatus 20 with respect to the book binding machine 1.

A runner 75, which is an elongated member with a U-shaped cross-section having an longitudinally extending and upwardly open groove 76, is attached to a lower part on the outside of one of the outer walls of the paper supplying apparatus 20 opposite to the book binding machine 1, as shown in FIGS. 9 and 10. Rollers 78 are attached to the bottom of the paper supplying apparatus 20. When the book binding machine 1 and the paper supplying apparatus 20 are used in combination, the downwardly bent portion 71 of the guide rail 70 is inserted into the groove 76 along the runner 75, and the paper supplying apparatus 20 is appropriately maneuvered such that one end of the runner 75 on the paper supplying apparatus 20 will come into contact with the stopper 73 on the guide rail 70 such that the paper supplying apparatus 20 will be opposite to the clamping station 2 of the book binding machine 1.

After the paper supplying apparatus 20 is thus connected to the book binding machine 1, the combined system is ready to supply book blocks to the clamping station 2 of the book binding machine 1.

When the book binding machine 1 is used directly by an operator or when a maintenance work is carried out on the book binding machine 1, one has only to push the paper supplying apparatus 20 in the direction of the guide rail 70. As the paper supplying apparatus 20 moves along the guide rail 70 and away from the book binding machine 1, the operator can secure a work space near the book binding machine 1. When the paper supplying machine 20 is returned to the connected position, it has only to be pushed along the guide rail 70 until it comes into contact with the stopper 73 of the guide rail 70.

Figure 11:
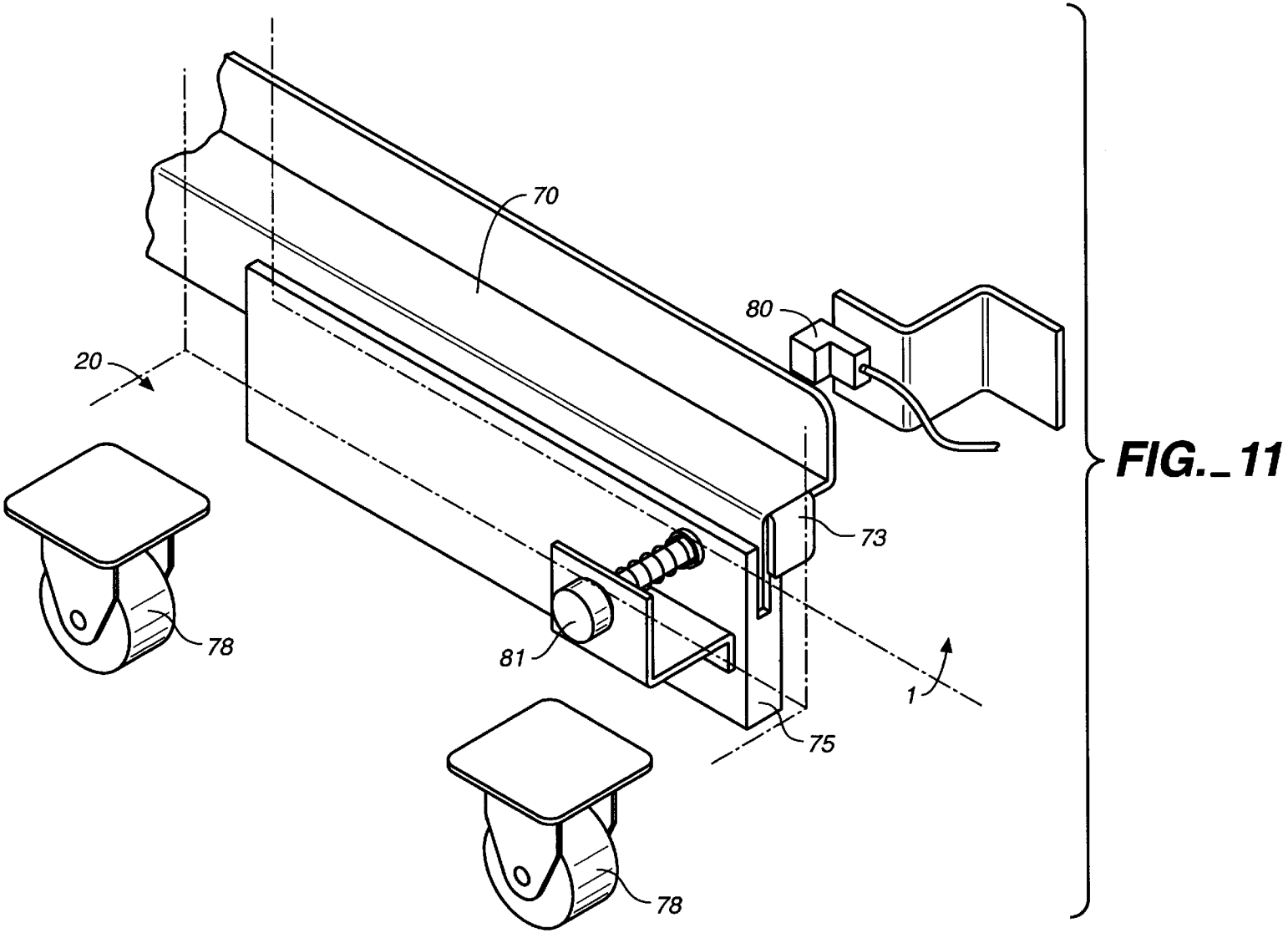
FIG. 11 is a schematic diagonal view of another connecting mechanism embodying this invention.
Figure 12:
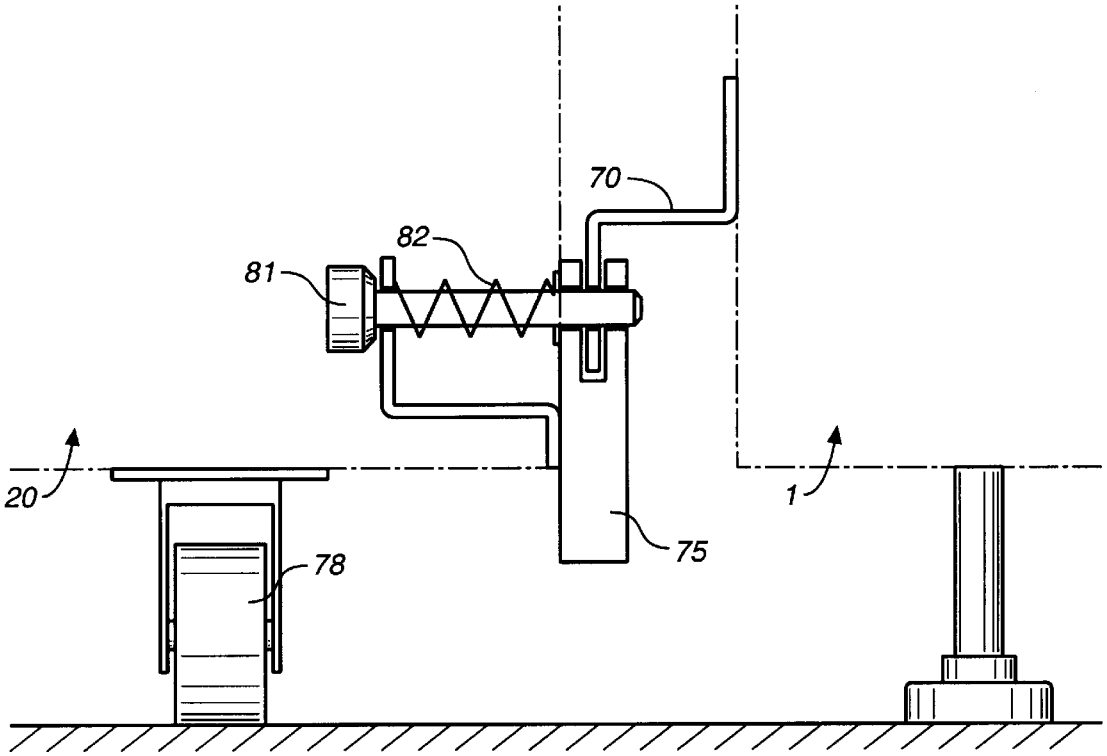
FIG. 12 is a sectional view of a portion of the connecting mechanism of FIG. 11.
Figure 13:
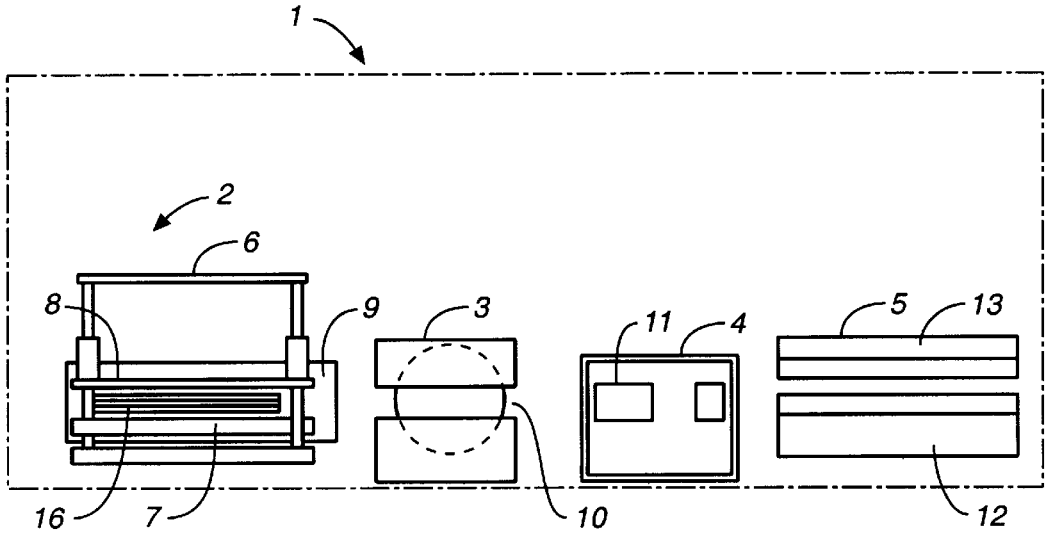
FIG. 13 (PRIOR ART)
FIG. 13 is a schematic plan view of a prior art book binding machine to which a paper supplying apparatus embodying this invention serves to supply book blocks.
Figure 14:
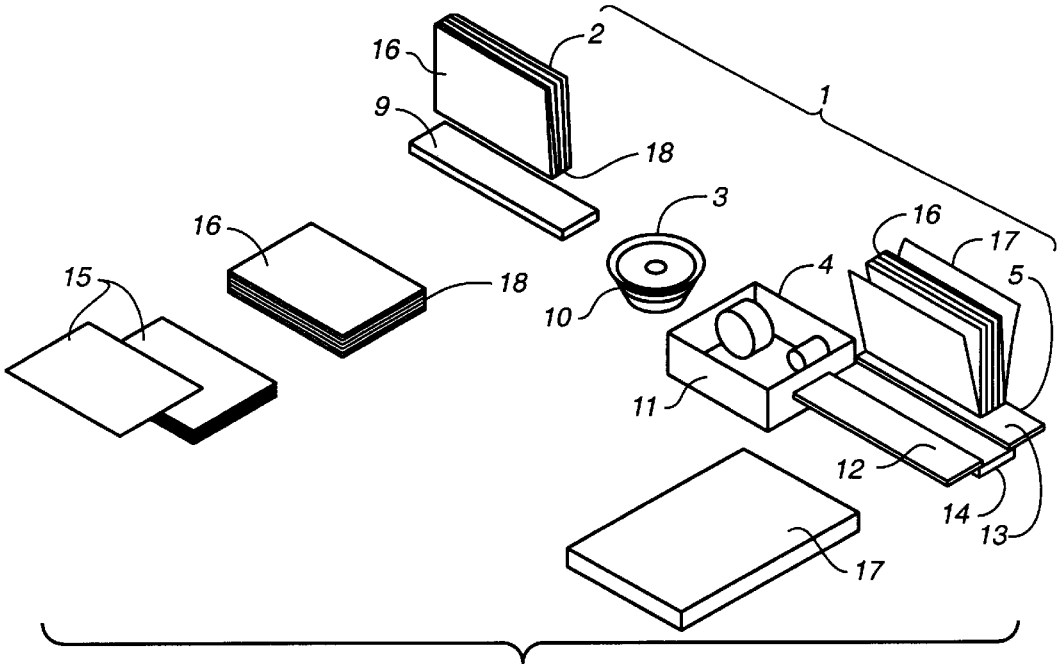
FIG. 14 (PRIOR ART)
FIG. 14 is a schematic drawing for showing a book binding process performed by the book binding machine shown in FIG. 13.
Figure 15:
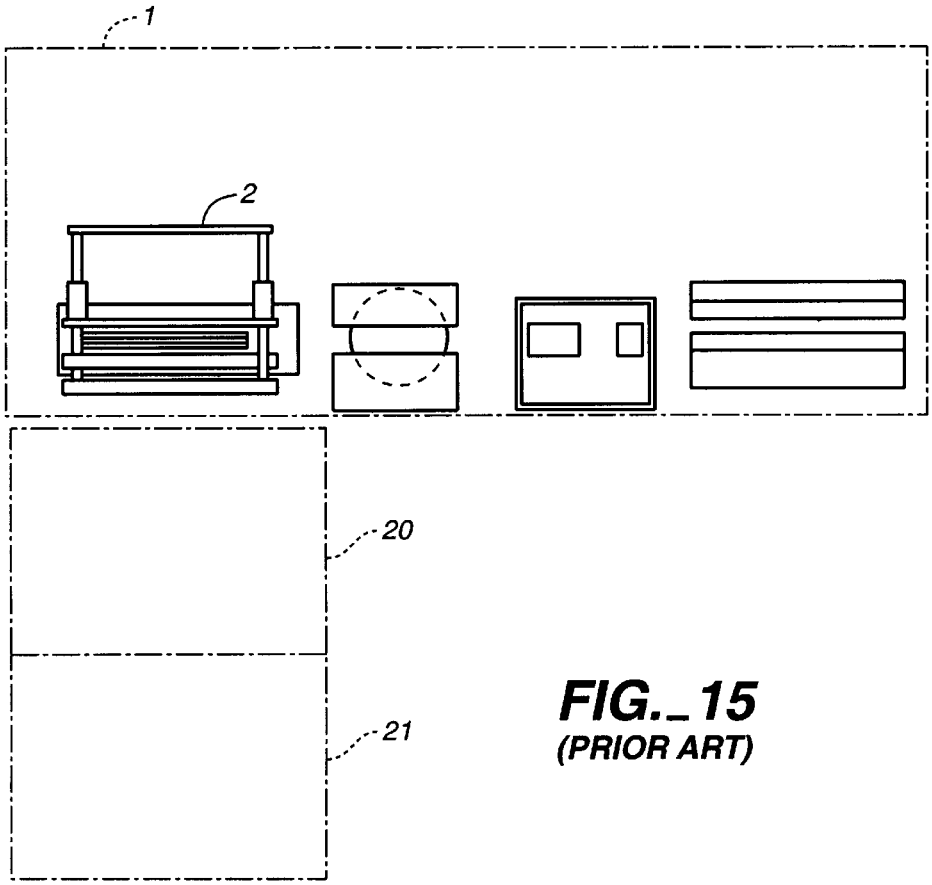
FIG. 15 (PRIOR ART)
FIG. 15 is a schematic plan view of the prior art book binding machine of FIG. 13 which is in use together with a paper supplying apparatus and a printer or a copier.
Figure 16:
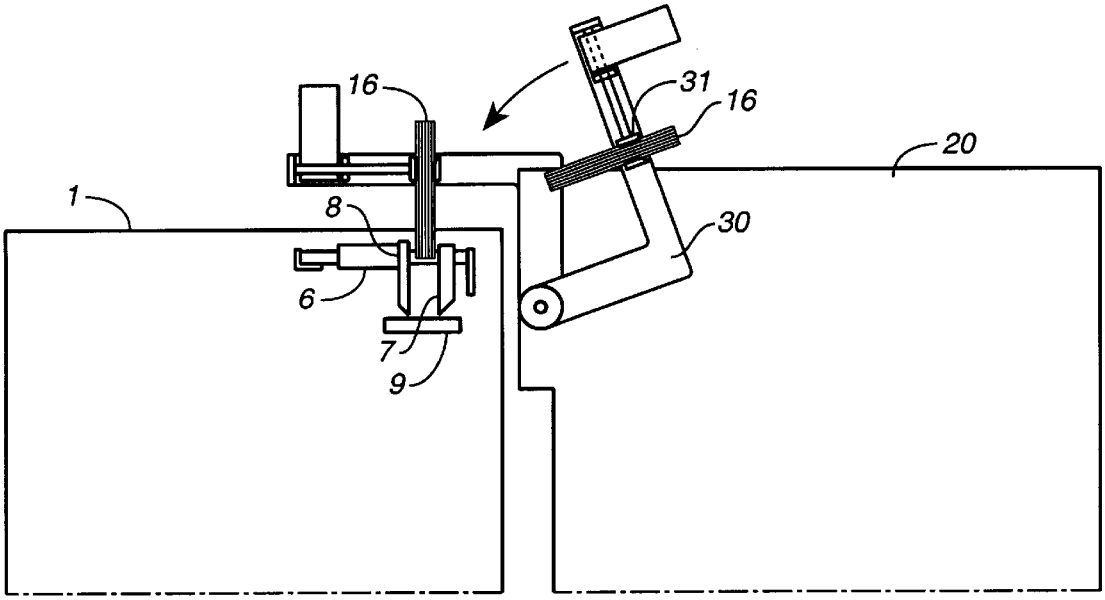
FIG. 16 (PRIOR ART)
FIG. 16 is a schematic side view of a prior art paper supplying apparatus supplying a book block to a book binding machine.
Figure 17:
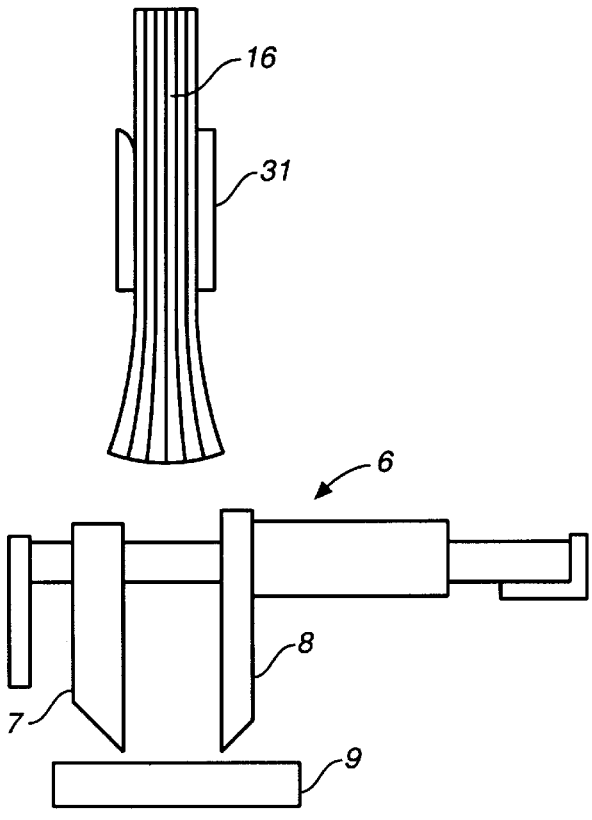
FIG. 17 (PRIOR ART)
FIG. 17 is an enlarged sectional view of a portion of the paper supplying apparatus about to deliver a book block to the clamper of a book binding machine.

As shown in FIG. 11, a magnetic detector 80, serving as a position sensor for the paper supplying apparatus 20 may be attached on the outer wall of the book binding machine 1 above the runner 70 near its stopper 73 for ascertaining a correct positioning of the paper supplying apparatus 20 with respect to the book binding machine 1. As shown both in FIGS. 11 and 12, furthermore, a plug 81 may be provided to the runner 75 with a biasing spring 82 around it such that, when the paper supplying apparatus 20 has been properly positioned with respect to the book binding machine 1, say, as assured by the position sensor 80, the plug 81 can be pushed in against the biasing force of the spring 82 through holes (not shown) through the runner 75 and the guide rail 70 and twisted for locking the paper supplying apparatus 20 with respect to the book binding machine 1 according to a well known mechanism.

Although the invention has been described above with reference to only a single example, it is not to be interpreted as limiting the scope of the invention. Many modifications and variations are possible within the scope of the invention. In particular, the shapes and structures of the guide rail and the runner can be freely modified. The rollers need not be directly attached to the paper supplying apparatus. In summary, the present invention provides an improved paper supplying apparatus capable of reliably delivering a book block to a book binding machine and can be easily connected or removed from the associated book binding machine.

What is claimed is:

1. An apparatus for supplying a book block from above to a clamper for a book binding machine, said apparatus comprising:

a rotatable member around a horizontal axis;

a pair of clamp plates supported by said rotatable member mutually parallel and in face-to-face relationship adapted to clamp said book block therebetween; and guide plates each attached to an associated one of said clamp plates, said guide plates extending downward from said clamp plates to a lower edge part of said book block when said book block is held vertically between said clamp plates to be delivered to said clamper.

2. The apparatus of claim 1 wherein one of said clamp plates is affixed to said rotatable member, and the other of said clamp plates is mobile towards or away from said affixed clamp plate while retaining said mutual parallel relationship, said apparatus further comprising means for causing said mobile clamp plate to move selectably towards or away from said affixed clamp plate.

3. The apparatus of claim 1 further comprising means for causing said rotatable member to rotate around said horizontal axis between a first position wherein said clamp plates are both horizontal and a second position wherein said clamp plates are both vertical.

4. The apparatus of claim 1 wherein said book binding machine has a guide rail attached to an outer wall thereof, said apparatus further comprising a runner, said runner being slidably engageable with said guide rail and capable of allowing said apparatus to move along said guide rail selectably towards or away from said book binding machine.

5. The apparatus of claim 4 herein said guide rail is horizontal and extends sideways from said outer wall between a first end away from said outer wall and a second end in front of said outer wall near said clamper.

6. The apparatus of claim 5 wherein said guide rail has stoppers at said first and second ends for blocking the motion of said apparatus along said guide rail.

7. The apparatus of claim 1 wherein said book binding machine has a position sensor for detecting the presence of said apparatus near said clamper.

8. The apparatus of claim 1 further comprising a plug adapted to be pushed in through holes in said guide rail and said runner to lock said apparatus to said book binding machine.

* * * * *